US006604642B1

(12) United States Patent
Barruw

(10) Patent No.: US 6,604,642 B1
(45) Date of Patent: Aug. 12, 2003

(54) BOTTLE HAVING AN OFFSET NECK

(75) Inventor: Jacob Barruw, Delray Beach, FL (US)

(73) Assignees: Charlotte Barruw, Delray Beach, FL (US); part interest; Owen A. Barruw, Boca Raton, FL (US); part interest ( * ) Notice: Subject to any disclaimer, the term of this patent is extended or adjusted under 35 U.S.C. 154(b) by 0 days.

(21) Appl. No.: 10/303,171

(22) Filed: Nov. 25, 2002

Related U.S. Application Data

(60) Provisional application No. 60/366,186, filed on Mar. 21, 2002.

(51) Int. Cl.[7] ..... B65D 23/00; B65D 1/02

(52) U.S. Cl. ..... 215/40; 215/44

(58) Field of Search ..... 215/40, 44, 11.4, 215/14; 222/107

(56) References Cited

U.S. PATENT DOCUMENTS

| | | | | | |
|---|---|---|---|---|---|
| 246,879 | A | * | 9/1881 | Hall | 215/40 |
| 1,419,747 | A | * | 6/1922 | Miller | 215/14 |
| D136,976 | S | | 1/1944 | Ostrin | |
| 2,514,744 | A | * | 7/1950 | Cipyak | 215/40 X |
| D192,978 | S | * | 6/1962 | Garvey | 215/40 X |
| 3,145,867 | A | * | 8/1964 | Roberts et al. | 215/11.1 |
| D213,670 | S | | 4/1969 | Waddington et al. | |
| 3,608,017 | A | * | 9/1971 | Cines | 215/40 X |
| 3,784,038 | A | * | 1/1974 | Uhlig | 215/31 X |
| 4,133,457 | A | * | 1/1979 | Klassen | 222/212 |
| 4,167,186 | A | * | 9/1979 | Pick et al. | 128/232 |
| 4,186,882 | A | * | 2/1980 | Szczepanski | 222/212 X |
| 4,437,587 | A | * | 3/1984 | Duering | 222/207 |
| D288,528 | S | | 3/1987 | Parad | |
| 4,676,387 | A | | 6/1987 | Stephenson et al. | |
| D299,428 | S | | 1/1989 | Wilfond | |
| D308,330 | S | | 6/1990 | Teece | |
| D308,481 | S | | 6/1990 | Thompson | |
| D310,026 | S | | 8/1990 | Verebelyi | |
| D310,960 | S | | 10/1990 | Verebelyi | |
| D316,754 | S | * | 5/1991 | Lau | 215/11.1 X |
| 5,079,013 | A | * | 1/1992 | Belanger | 215/11.4 X |
| D325,520 | S | | 4/1992 | Biesecker | |
| 5,226,574 | A | | 7/1993 | Durinzi, Jr. | |
| 5,230,707 | A | * | 7/1993 | Laderoute | 604/86 |
| D340,865 | S | | 11/1993 | Endre | |
| 5,269,425 | A | * | 12/1993 | Gomez-Acevedo | 215/11.4 X |
| D371,849 | S | | 7/1996 | Thom | |
| 5,597,087 | A | * | 1/1997 | Vinarsky | 215/40 X |
| D378,573 | S | | 3/1997 | Sherman | |
| D382,968 | S | | 8/1997 | Giles et al. | |
| D383,678 | S | | 9/1997 | Syrek | |
| 5,664,705 | A | * | 9/1997 | Stolper | 222/212 |
| D389,065 | S | | 1/1998 | Goettner | |
| D391,489 | S | | 3/1998 | Feen | |
| D392,568 | S | | 3/1998 | Goettner | |
| D394,113 | S | | 5/1998 | Walsh et al. | |
| 5,791,503 | A | * | 8/1998 | Lyons | 215/11.5 |
| D399,005 | S | | 9/1998 | Chan et al. | |
| D402,561 | S | | 12/1998 | Utrup et al. | |
| D409,495 | S | | 5/1999 | Hartman et al. | |
| D414,115 | S | | 9/1999 | Goettner et al. | |
| 5,992,656 | A | * | 11/1999 | Dujardin et al. | 215/44 |
| D428,496 | S | | 7/2000 | Thom et al. | |
| 6,173,850 | B1 | | 1/2001 | Scheetz, Jr. et al. | |
| 6,305,562 | B1 | | 10/2001 | Chan et al. | |
| D451,029 | S | | 11/2001 | Hoffman | |

FOREIGN PATENT DOCUMENTS

| | | | | | |
|---|---|---|---|---|---|
| DE | 3441172 | | * | 5/1986 | 215/40 |
| DE | 19804722 | A1 | * | 8/1998 | |
| DK | 64840 | | * | 9/1946 | 215/40 |
| EP | 753355 | | * | 1/1997 | |
| GB | 561707 | | * | 6/1944 | 215/40 |

* cited by examiner

*Primary Examiner*—Sue A. Weaver
(74) *Attorney, Agent, or Firm*—Tipton L. Randall

(57) ABSTRACT

A bottle having an offset neck includes a symmetrical body having a longitudinal axis and a closed, flat, bottom end and a bottle neck section opposite the bottle bottom end, the neck section having a proximal neck portion connected to the body and aligned along the body's longitudinal axis. A distal neck portion smaller than the body includes an opening into the bottle, with the distal neck portion and bottle opening offset with respect to the body's longitudinal axis.

8 Claims, 9 Drawing Sheets

BOTTLE HAVING AN OFFSET NECK

CROSS-REFERENCE TO RELATED APPLICATIONS, IF ANY

This application claims the benefit under 35 U.S.C. §119 (e) of co-pending provisional application Ser. No. 60/366,186, filed Mar. 21, 2002. application Ser. No. 60/366,186 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a bottle. More particularly, the present invention relates to a bottle with an offset neck. Most particularly, the bottle includes a bottle with a neck offset from the longitudinal axis of the bottle body.

2. Background Information

Bottles for storing and dispensing liquids are well known. Generally, bottles have a round, cylindrical body, although square or oblong bottle bodies are also known. The neck of most bottles is symmetrically located on the longitudinal axis of the bottle body with the neck opening also symmetrically positioned on the longitudinal axis of the bottle body. Often edible liquids, such as milk, wine, beer or soft drinks, are consumed directly from the bottle. Such bottles are not adapted for easy use when the individual is partially reclined or in a horizontal position. The use of a flexible straw inserted into the bottle helps to attain easy drinking in a horizontal position, but a straw may not be readily available on all occasions.

Some examples of bottles for which design patents have been granted include the following. U.S. Pat. Des. No. 136,976 by Ostrin; U.S. Pat. Des. No. 213,670 by Waddington et al; U.S. Pat. Des. No. 288,528 by Parad; U.S. Pat. Des. No. 299,428 by Wilfond; U.S. Pat. Des. No. 308,330 by Teece; U.S. Pat. Des. No. 308,481 by Thompson; U.S. Pat. Des. No. 310,026 by Verebelyi; U.S. Pat. Des. No. 310,960 by Verebelyi; U.S. Pat. Des. No. 325,520 by Biesecker; U.S. Pat. Des. No. 340,865 by Endre; U.S. Pat. Des. No. 371,849 by Thom; U.S. Pat. Des. No. 378,573 by Sherman; U.S. Pat. Des. No. 382,968 by Giles et al; U.S. Pat. Des. No. 383,678 by Syrek; U.S. Pat. Des. No. 389,065 by Goettner; U.S. Pat. Des. No. 391,489 by Feen; U.S. Pat. Des. No. 392,568 by Goettner; U.S. Pat. Des. No. 394,113 by Walsh et al.; U.S. Pat. Des. No. 399,005 by Chan et al.; U.S. Pat. Des. No. 402,561 by Utrup et al.; U.S. Pat. Des. No. 409,495 by Hartman et al.; U.S. Pat. Des. No. 428,496 by Thom et al.; U.S. Pat. Des. No. 414,115 by Goettner et al.; and U.S. Pat. Des. No. 451,029 by Hoffmann.

Utility patents for various bottles have been granted to Stephenson et al. in U.S. Pat. No. 4,676,387; Durinzi, Jr., in U.S. Pat. No. 5,226,574; Scheetz, Jr. et al. in U.S. Pat. No. 6,173,850, and Chan et al. in U.S. Pat. No. 6,305,562. All of these patents have various short comings that are believed to be overcome by the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention, as defined by the appended claims.

SUMMARY OF THE INVENTION

The invention is directed to a bottle having an offset neck. The bottle includes a symmetrical body section having a longitudinal axis and a closed, flat, bottom end. A bottle neck section opposite the bottle end has a proximal neck portion connected to the body section and aligned along the longitudinal axis thereof, and a distal neck portion smaller than the body section. The distal neck portion includes an opening into the bottle, the distal neck portion and bottle opening having a bore axis, with the distal neck portion and bottle opening offset with respect to the body section's longitudinal axis.

In a further embodiment of the invention, the opening into the bottle includes a diaphragm with an aperture therein. The features, benefits and objects of this invention will become clear to those skilled in the art by reference to the following description, claims, and several drawings.

DESCRIPTION OF THE EMBODIMENTS

Nomenclature

10 Bottle Member
20 Body Section of Bottle Member
25 Bottom End of Body Section

30 Neck Section of Bottle Member
35 Proximal Neck Portion
40 Distal Neck Portion
45 Opening in Neck Section
50 External Threads of Distal Neck Portion
55 Diaphragm
60 Aperture in Diaphragm
L Longitudinal Axis of Body Section
B Bore Axis of Distal Neck Portion and Neck Opening

Construction

Figure 1:
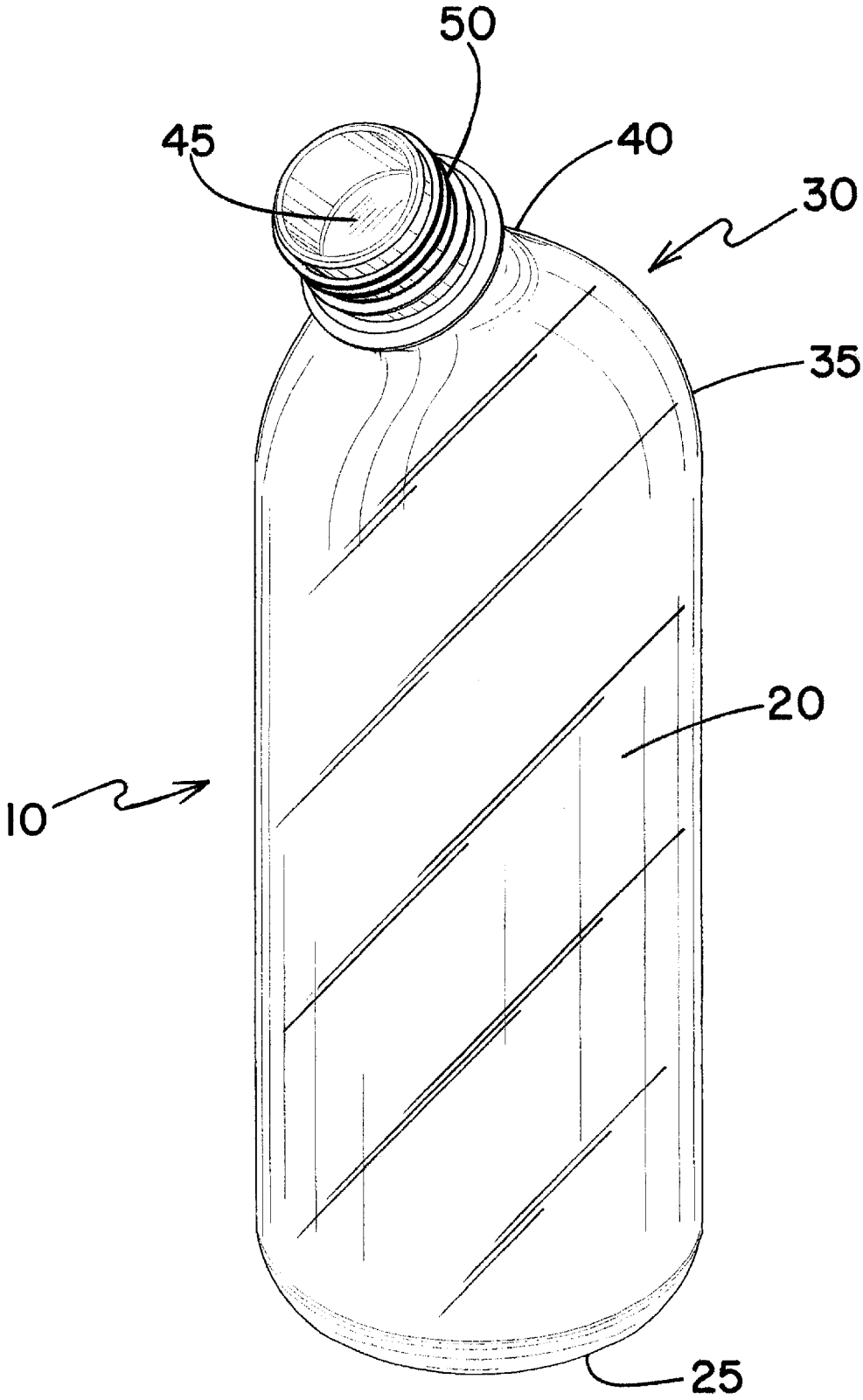
FIG. 1 is a perspective elevational view of one embodiment of the bottle with an offset neck of the present invention.
Figure 2:
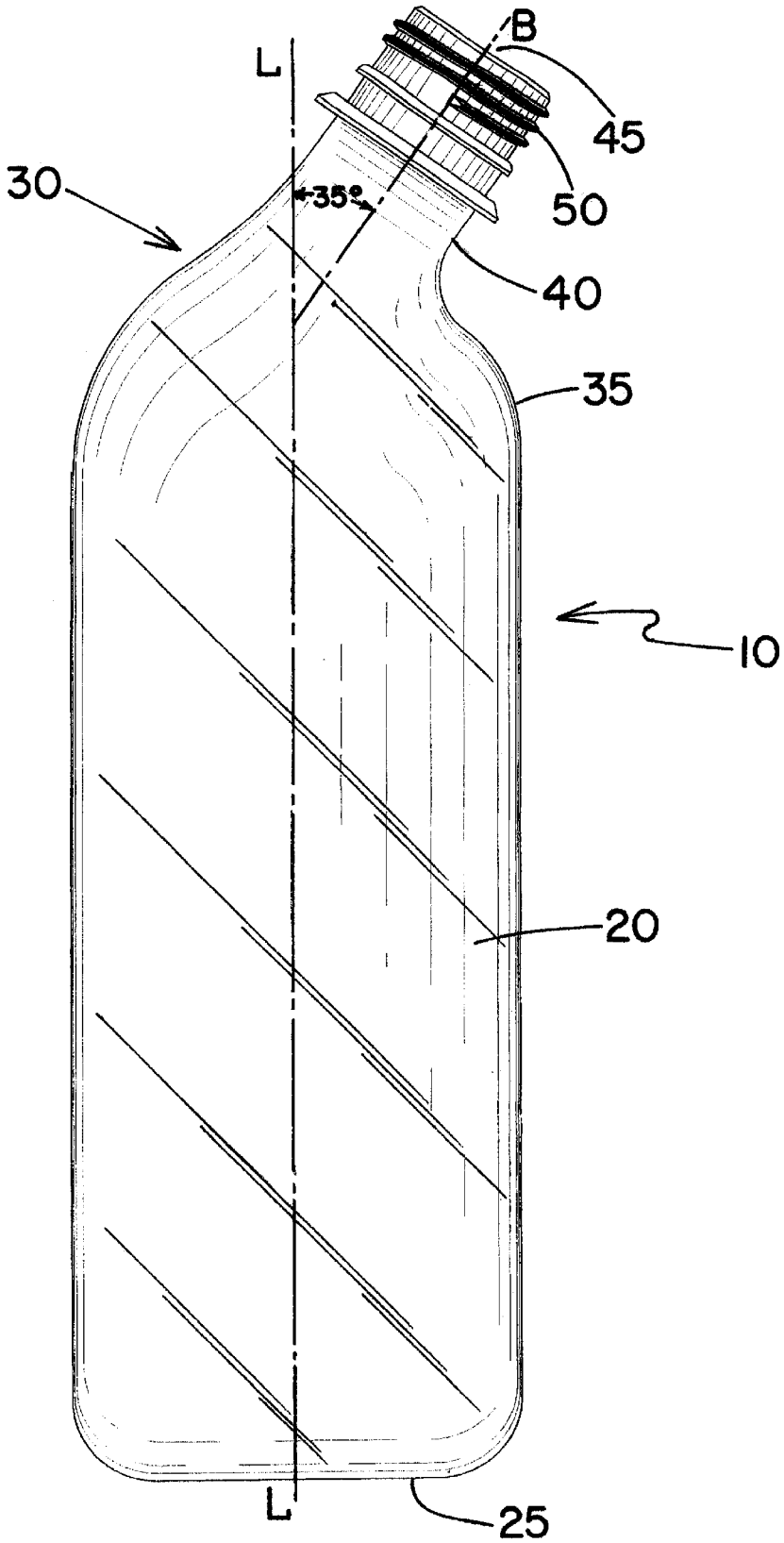
FIG. 2 is a side view of the bottle with an offset neck of FIG. 1 of the present invention.
Figure 3:
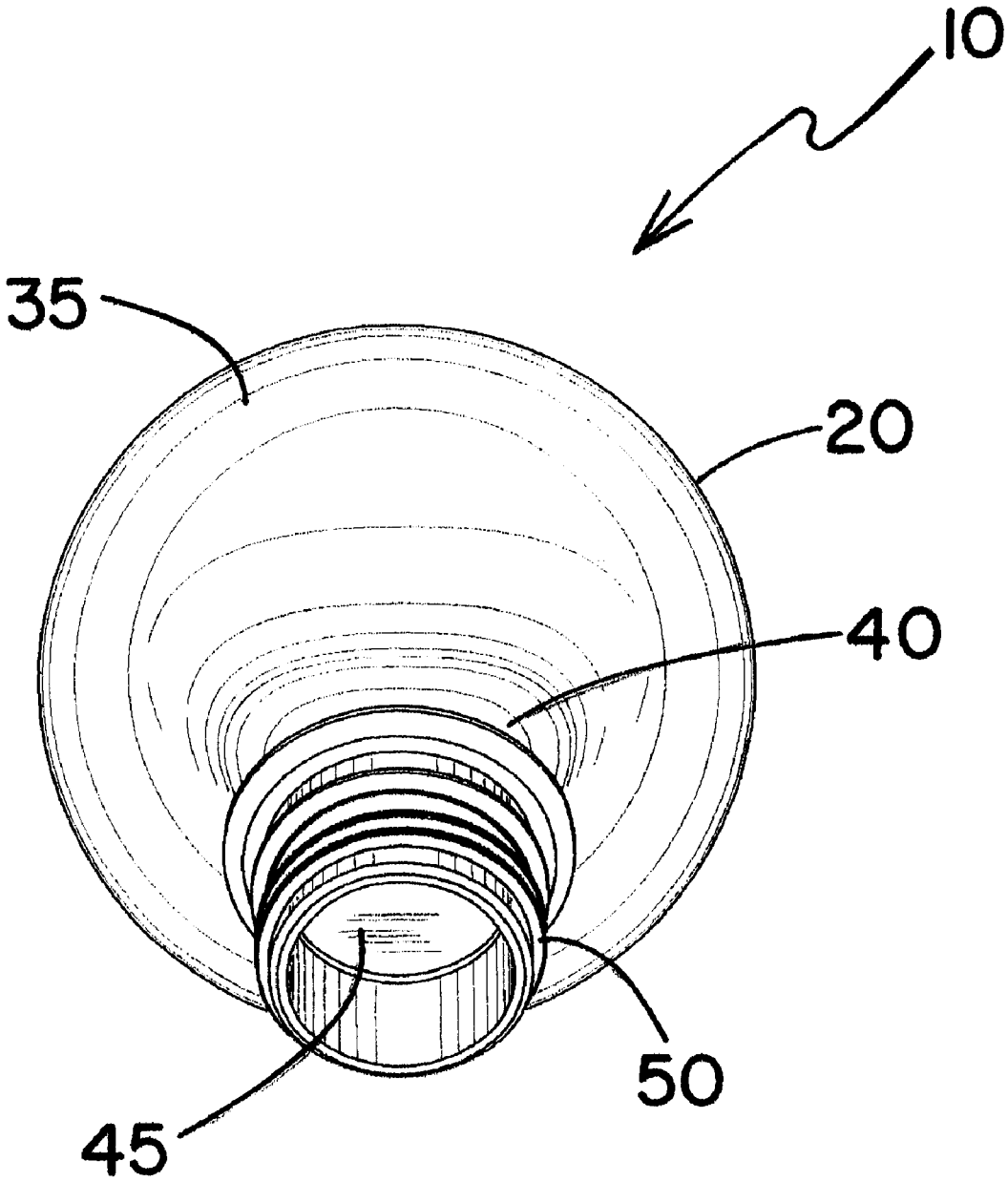
FIG. 3 is a top plan view of the bottle with an offset neck of FIG. 1 of the present invention.

Referring to FIGS. 1–3, one embodiment of the bottle with an offset neck is shown. The bottle member 10 includes a symmetrical body section 20 having a longitudinal axis L and a closed, flat, bottom end 25. Preferably, the body section 20 is cylindrical. A bottle neck section 30 is positioned opposite the bottle bottom end 25, with the neck section 30 having a proximal neck portion 35 connected to the body section 20 and aligned along the longitudinal axis L of the body section 20. The neck section 30 also includes a distal neck portion 40 smaller than the body section 20, with the distal neck portion 40 including an opening 45 into the bottle member 10. Preferably, the bottle opening 45 is essentially the same size as the distal neck portion 40. The distal neck portion 40 and the bottle opening 45 are offset to one side with respect to the body section's longitudinal axis L, as seen in FIG. 2. In this embodiment, the bore axis B of the distal neck portion 40 and neck opening 45 therein forms a 35° angle relative to the body section's longitudinal axis L. In a further embodiment of the invention, the distal neck portion 40 includes external threads 50 adjacent the bottle opening 45, which are adapted for securing an internally threaded cover (not shown) over the bottle opening 45. Preferably, the bottle member 10, including the body section 20 and the neck section 30, is fabricated from a polymeric, synthetic resin material, such as polyethylene.

Figure 6:
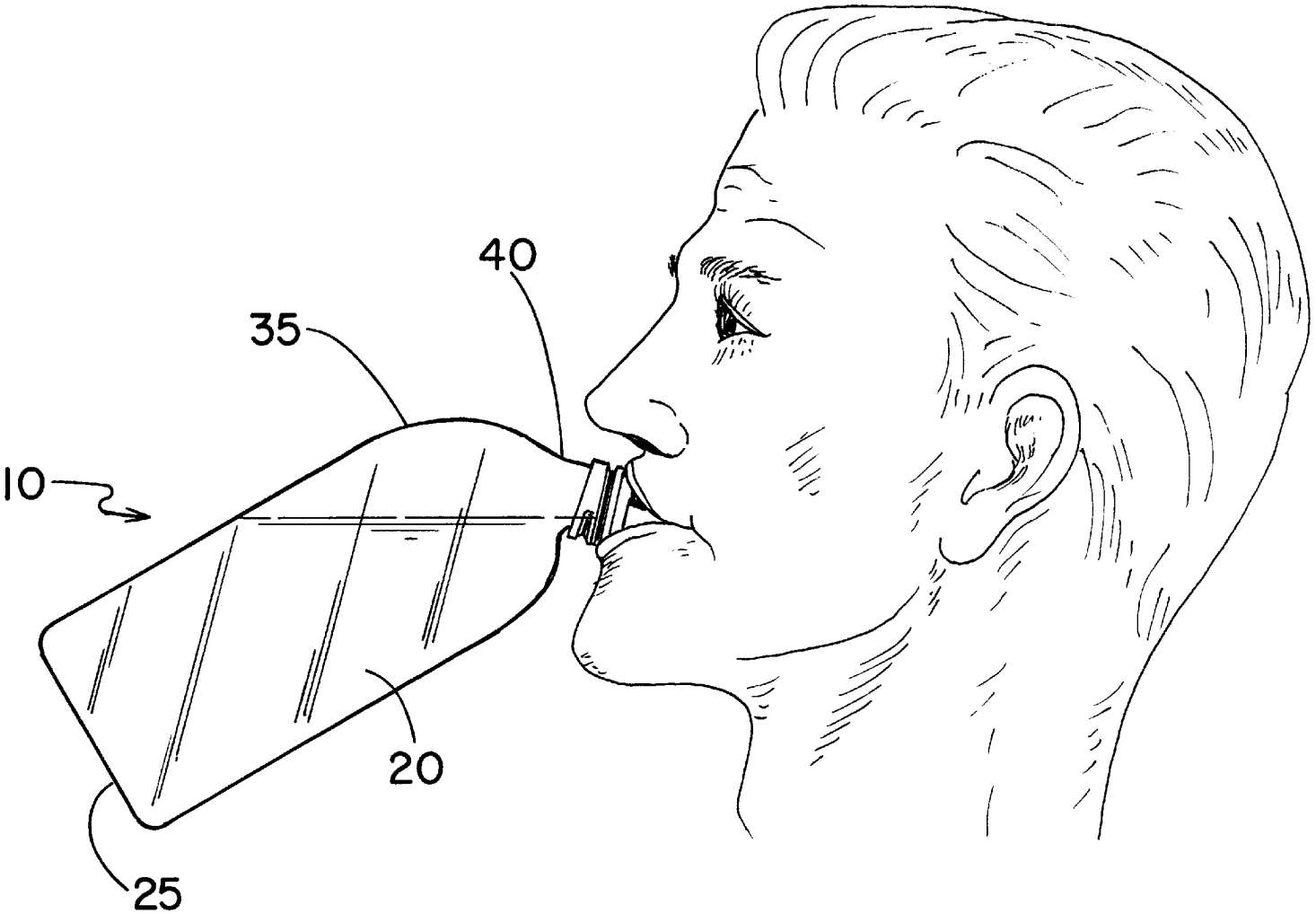
FIG. 6 is a schematic view showing a person drinking from the bottle of FIG. 1.

The bottle member 10 is particularly well suited for consuming liquids contained therein, where an individual is reclining or in a prone position. Preferably, the distal neck portion 40 with the bottle opening 45 is sized so an individual can insert the distal neck portion 40 into the mouth with the bottle member longitudinal axis L in a vertical or near vertical orientation. Preferably, the bottle opening has a diameter of about 2 centimeters. The bottle member 10 is then inclined to deliver liquid through the bottle opening 45 into the individual's mouth in a controlled manner, as illustrated in FIG. 6.

Figure 4:
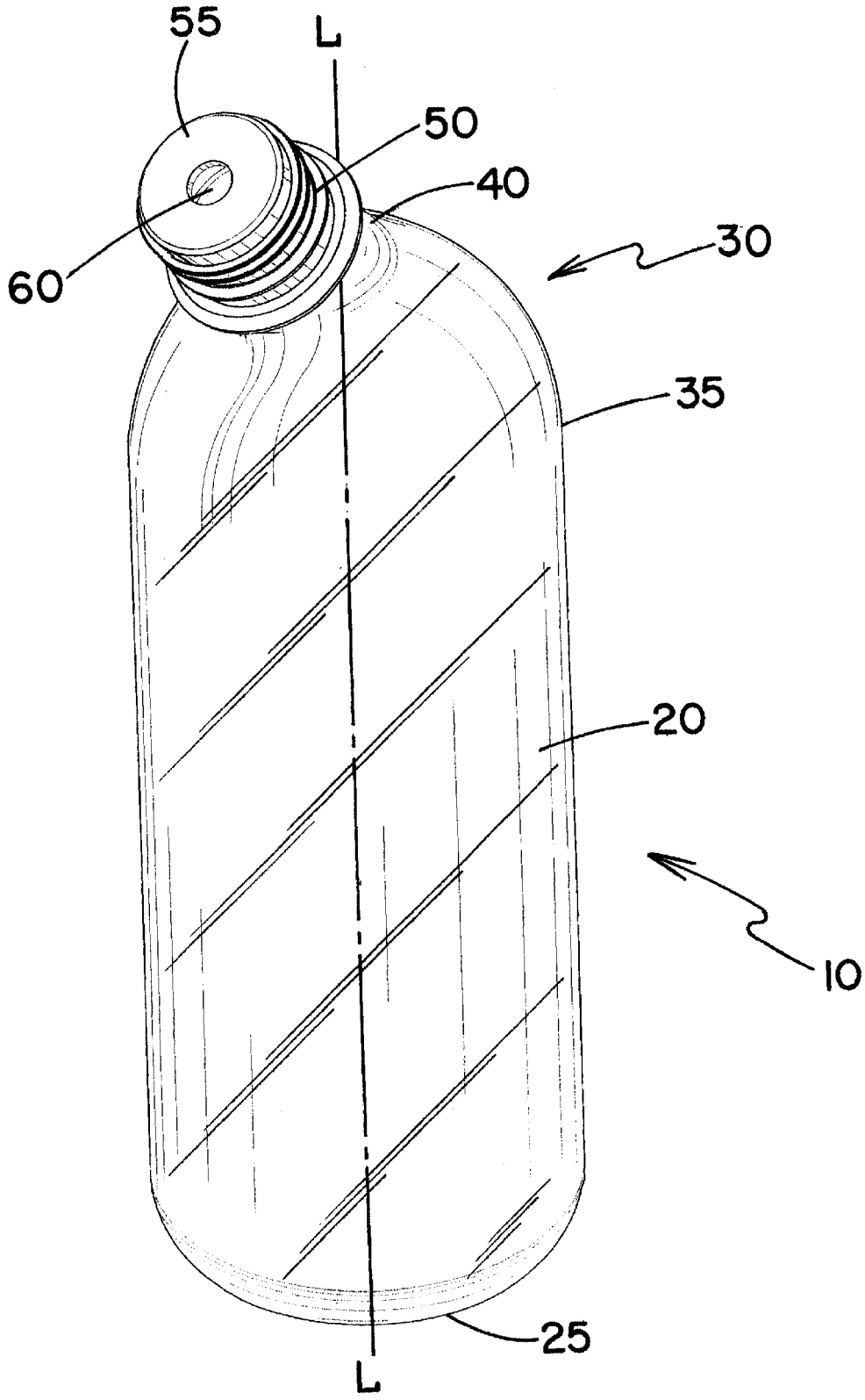
FIG. 4 is a perspective elevational view of another embodiment of the bottle with an offset neck of the present invention.
Figure 5:
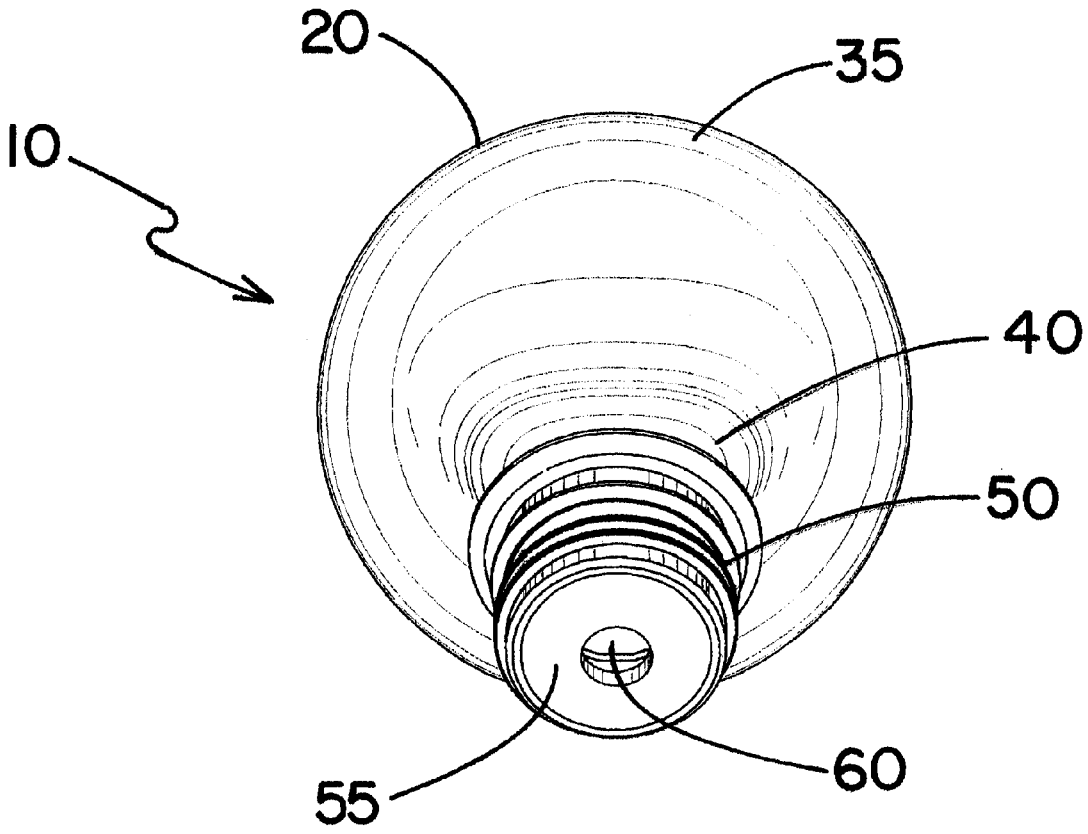
FIG. 5 is top plan view of the bottle with an offset neck of FIG. 4 of the present invention.

Referring now to FIGS. 4 and 5, a further embodiment of the bottle with an offset neck is shown. The bottle member 10 includes a symmetrical body section 20 having a longitudinal axis L and a closed, flat, bottom end 25. Preferably, the body section 20 is cylindrical. A bottle neck section 30 is positioned opposite the bottle bottom end 25, with the neck section 30 having a proximal neck portion 35 connected to the body section 20 and aligned along the longitudinal axis L of the body section 20. The neck section 30 also includes a distal neck portion 40 smaller than the body section 20, with the distal neck portion 40 including an opening 45 into the bottle member 10. Preferably, the bottle opening 45 is essentially the same size as the distal neck portion 40. The distal neck portion 40 and the bottle opening 45 are offset to one side with respect to the body section's longitudinal axis L, as seen in FIG. 4, again with the bore axis B of the distal neck portion and bottle opening 45 therein forming a 35° angle relative to the body section's longitudinal axis L. The distal neck portion 40 includes external threads 50, which are adapted for securing an internally threaded cover (not shown) over the bottle opening 45. As shown in FIGS. 4 and 5, a diaphragm 55 is secured within the bottle opening 45. The diaphragm 55 includes an aperture 60 that is smaller than the bottle opening 45 for transfer of liquid into and out of the bottle member 10. An internally threaded cover (not shown) is secured over the diaphragm aperture 60 by engaging the external threads 50 of the bottle's distal neck portion 40.

Preferably, the bottle member 10, including the body section 20, the neck section 30 and the diaphragm 55, is fabricated from a polymeric, synthetic resin material, such as polyethylene. Preferably, the bottle member 10 and diaphragm 55, with an aperture 60, are fabricated as a unitary item, for example, by a blow molding process using a polymeric, synthetic resin material. Most preferably, the bottle member's body section 20 has a wall thickness to allow the body section 20 to be flexible. The flexible body section 20 thus can be deformed, for example, by squeezing it with one's hand.

Preferably, the aperture 60 in the diaphragm 55 has a diameter of about 0.5 centimeters. With the bottle member 10 fitted with a diaphragm 55, having an aperture 60 and filled with liquid, an aperture 60 of about 0.5 centimeters allows the bottle member 10 to be inverted without the liquid emptying therefrom. Applying hand pressure to the body section 20 causes a stream of liquid to be expelled from the aperture 60. When pressure to the body section 20 is released, the flexible body section 20 expands to its original shape and draws air into the bottle member 10. Once the pressure inside the bottle member 10 is equalized, with the air rising to the upturned bottom end 25, the liquid is ready for dispensing with another application of hand pressure to the body section 20. Thus, several individuals can obtain liquid from the same bottle member 10 without the distal neck portion 40 touching their mouths. Thus, the bottle member 10, fitted with an apertured diaphragm 55, finds use in various athletic events where a quick drink of liquid by several participants is required.

Figure 7:
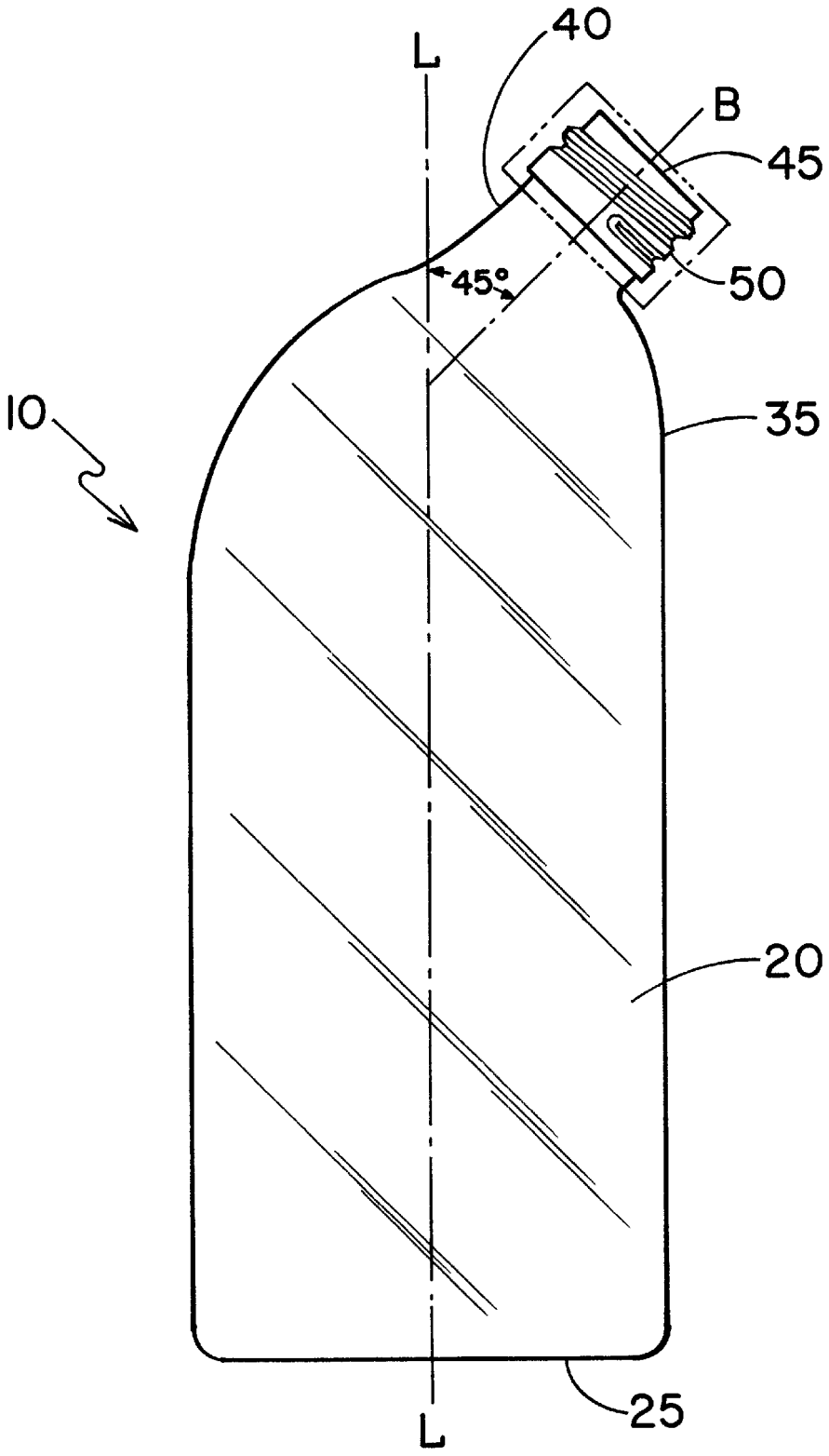
FIG. 7 is an elevational side view of another embodiment of a bottle with the neck distal end's bore axis disposed at a 45° angle to the bottle's longitudinal axis according to the present invention.

Referring now to FIG. 7, another embodiment of the bottle member 10 is shown. In this embodiment, the bore axis B of the distal neck portion 40 and bottle opening 45 therein forms a 45° angle relative to the body section's longitudinal axis L. An internally threaded cap is shown in phantom engaging the external threads 50 of the distal neck portion 40.

Figure 8:
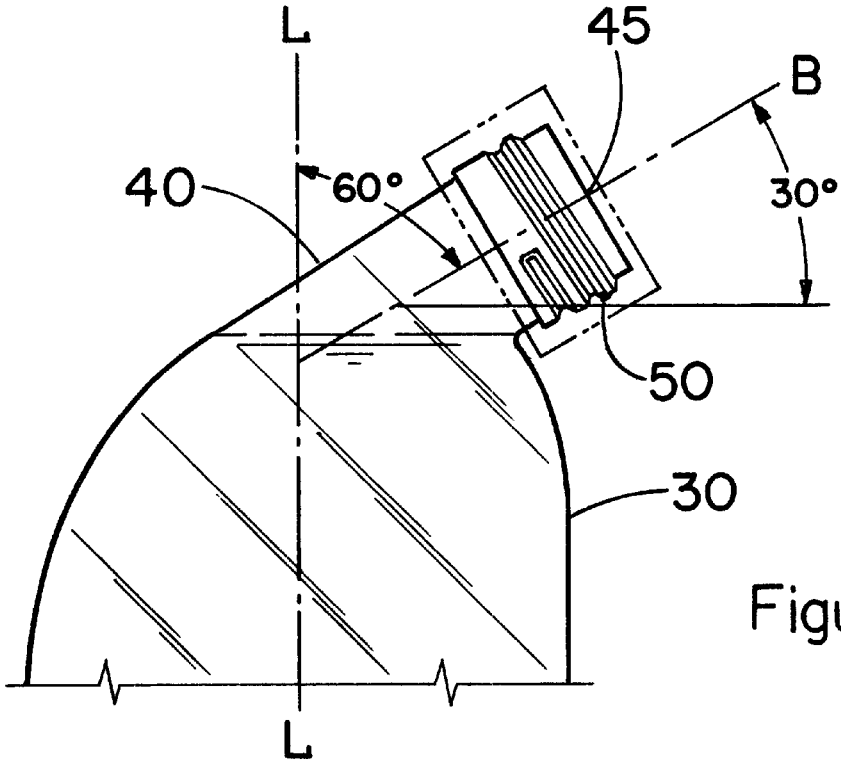
FIG. 8 is a partial elevational view of another embodiment of a bottle with the neck distal end's bore axis disposed at a 60° angle to the bottle's longitudinal axis according to the present invention.
Figure 9:
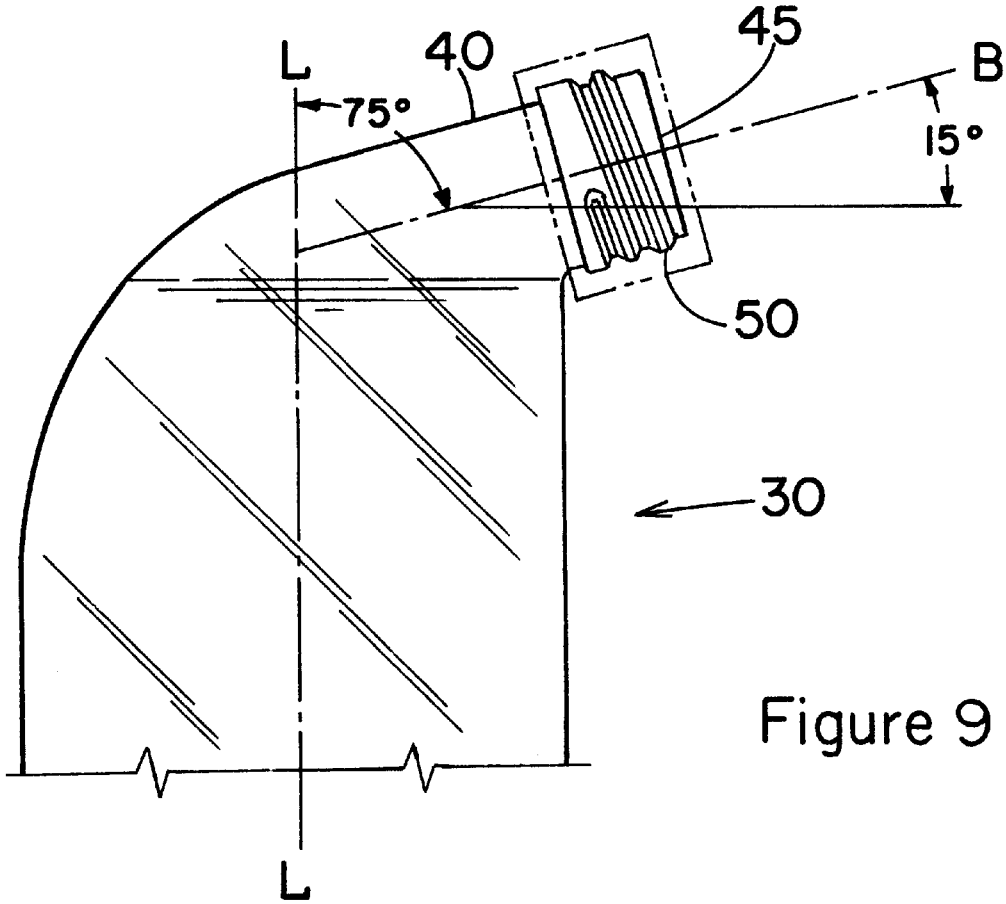
FIG. 9 is a partial elevational view of another embodiment of a bottle with the neck distal end's bore axis disposed at a 75° angle to the bottle's longitudinal axis according to the present invention.

Several alternative embodiments of the bottle member 10 are shown in FIGS. 8 and 9, where only the neck portion 30 and the bottle opening 45 are shown. In FIG. 8, the bore axis B of the distal neck portion 40 and bottle opening 45 therein forms a 60° angle relative to the body section's longitudinal axis L, while in FIG. 9, the bore axis B of the distal neck portion 40 and bottle opening 45 therein forms a 75° angle relative to the body section's longitudinal axis L.

Figure 10:
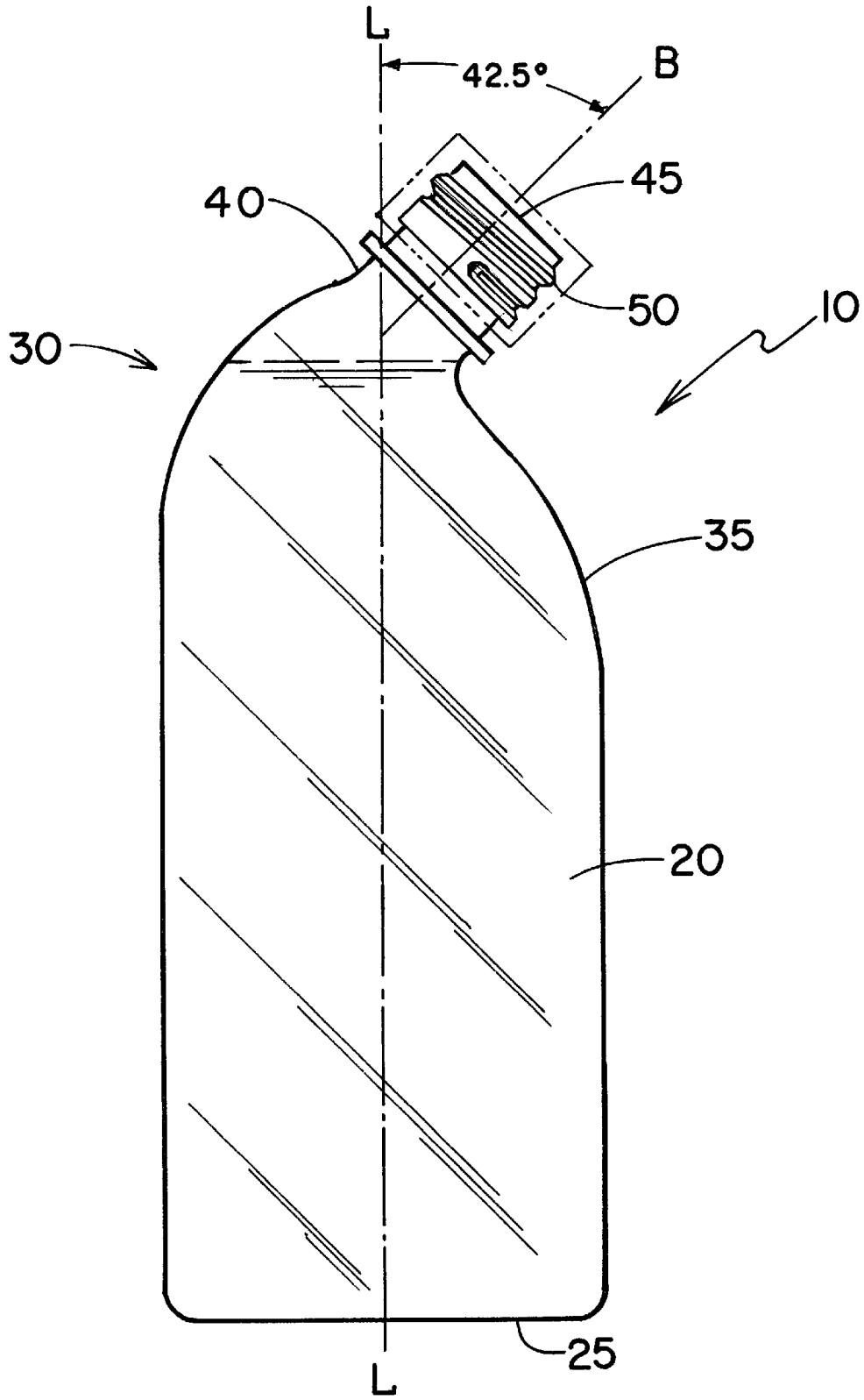
FIG. 10 is an elevational side view of another embodiment of a bottle with the neck distal end's bore axis disposed at a 42.5° angle to the bottle's longitudinal axis according to the present invention.

Yet another embodiment of the bottle member 10 is shown in FIG. 10. In this embodiment, the bore axis B of the distal neck portion 40 and bottle opening 45 therein forms a 42.5° angle relative to the body section's longitudinal axis L. An internally threaded cap also is shown in phantom engaging the external threads 50 of the distal neck portion 40 in FIGS. 8 through 10.

While the invention has been particularly shown and described with reference to preferred embodiments thereof, it will be understood by those skilled in the art that various changes in form and details may be made therein without departing from the spirit and scope of the invention.

I claim:

1. A bottle having an offset neck comprising;

(a) a symmetrical body section having a longitudinal axis and a closed, flat, bottom end; and (b) a bottle neck section opposite the bottle bottom end, the neck section having a proximal neck portion connected to the body section and aligned along the longitudinal axis thereof, and a distal neck portion smaller than the body section, the distal neck portion including an opening into the bottle essentially the same size as the distal neck portion, the distal neck portion and bottle opening having a bore axis intersecting the body section longitudinal axis at an angle between about 35° and about 75°, the distal neck portion having external threads adjacent the bottle opening, the threads adapted for securing an internally threaded cover thereto, the bottle section and neck section fabricated from a flexible, polymeric, synthetic resin material, the distal neck portion and bottle opening offset with respect to the body section's longitudinal axis.

2. The bottle having an offset neck of claim 1, wherein the symmetrical body section is cylindrical.

3. The bottle having an offset neck of claim 1, further including a diaphragm positioned in the bottle opening at an external end thereof, the diaphragm having a single aperture smaller than the bottle opening the aperture centered on the bottle opening bore axis.

4. The bottle having an offset neck of claim 1, wherein the polymeric resin is polyethylene.

5. A bottle having an offset neck comprising;

(a) a symmetrical, cylindrical body section having a longitudinal axis and a closed, flat, bottom end;

(b) a bottle neck section opposite the bottle bottom end, the neck section having a proximal neck portion connected to the body section and aligned along the longitudinal axis thereof, and a distal neck portion smaller than the body section, the distal neck portion including an opening into the bottle essentially the same size as the distal neck portion, the distal neck portion and bottle opening having a bore axis intersecting the body section longitudinal axis at an angle between about 35° and about 75° the distal neck portion having external threads adjacent the bottle opening, the threads adapted for securing an internally threaded cover thereto, the bottle section and neck section fabricated from a flexible, polymeric, synthetic resin material, the distal neck portion and bottle opening offset with respect to the body section's longitudinal axis; and (c) a diaphragm positioned in the bottle opening at an external end thereof, the diaphragm having a single aperture smaller than the bottle opening, the aperture centered on the bottle opening bore axis.

6. The bottle having an offset neck of claim 5, wherein the polymeric resin is polyethylene.

7. A bottle having an offset neck comprising;

(a) a symmetrical, cylindrical body section having a longitudinal axis and a closed, flat, bottom end; and (b) a bottle neck section opposite the bottle bottom end, the neck section having a proximal neck portion connected to the body section and aligned along the longitudinal axis thereof, and a distal neck portion smaller than the body section, the distal neck portion including an opening into the bottle, the distal neck portion and bottle opening having a bore axis intersecting the body section's longitudinal axis at an angle between about 35° and about 75°, the distal neck portion having external threads adjacent the bottle opening, the threads adapted for securing an internally threaded cover thereto, the bottle section and neck section fabricated from a flexible, polymeric, synthetic resin material, the distal neck portion and bottle opening offset with respect to the body section's longitudinal axis.

8. The bottle having an offset neck of claim 7, further including a diaphragm positioned in the bottle opening at an external end thereof, the diaphragm having a single aperture smaller than the bottle opening, the aperture centered on the bottle opening bore axis.

* * * * *